US011506365B2

(12) United States Patent
Chang et al.

(10) Patent No.: US 11,506,365 B2
(45) Date of Patent: Nov. 22, 2022

(54) HEAD-MOUNTABLE ILLUMINATORS WITH USER-SELECTABLE COLOR TEMPERATURE

(71) Applicant: General Scientific Corporation, Ann Arbor, MI (US)

(72) Inventors: Byung J. Chang, Ann Arbor, MI (US); Donghwan Kim, Gyeonggi-do (KR); Taekwan Yoon, Seoul (KR)

(73) Assignee: General Scientific/Surgitel, Ann Arbor, MI (US)

( * ) Notice: Subject to any disclaimer, the term of this patent is extended or adjusted under 35 U.S.C. 154(b) by 0 days.

(21) Appl. No.: 16/779,637

(22) Filed: Feb. 2, 2020

(65) Prior Publication Data

US 2022/0268426 A1 Aug. 25, 2022

Related U.S. Application Data

(60) Provisional application No. 62/904,316, filed on Sep. 23, 2019.

(51) Int. Cl.
*F21V 21/084* (2006.01)
*F21L 4/02* (2006.01)
(Continued)

(52) U.S. Cl.
CPC ..... *F21V 21/084* (2013.01); *F21L 4/027* (2013.01); *F21V 9/083* (2013.01); *F21V 9/40* (2018.02);
(Continued)

(58) Field of Classification Search
CPC .... F21V 23/006; F21V 23/04; F21V 23/0414; F21V 23/0428; F21V 21/084;
(Continued)

(56) References Cited

U.S. PATENT DOCUMENTS 9,901,414 B2 * 2/2018 Lively ..... A61B 90/361
10,091,854 B1 * 10/2018 Brandon, II ..... H05B 45/18
(Continued)

FOREIGN PATENT DOCUMENTS

CN 203023896 U * 6/2013
CN 104390161 A * 3/2015 ..... F21K 9/10
CN 208779346 U * 4/2019

*Primary Examiner* — Alan B Cariaso
(74) *Attorney, Agent, or Firm* — Law Offices of John G. Posa

(57) ABSTRACT

An illuminator enables the selection of different color temperatures for different medical, dental or surgical procedures. A first circuit board is moveable with respect to the housing and a second circuit board is fixed within the housing. A plurality of LEDs are mounted on the first circuit board, which receives power from electrical contacts between the two boards. A user control enables a user to move the first circuit board between different positions, wherein, in each position, different LEDs or combinations of the LEDs emit light through the light-transmission window. Movement of the user control may cause the first circuit board to rotate or slide relative the second circuit board. The source of electrical power may be remote or integrated batteries. The rear portion of the housing may include a mount for attaching the illuminator to eyeglass frames, a headband, or other head-mounting apparatus.

14 Claims, 9 Drawing Sheets

(51) Int. Cl.

| | |
|---|---|
| ***F21V 9/40*** | (2018.01) |
| ***F21V 9/08*** | (2018.01) |
| ***F21V 19/04*** | (2006.01) |
| ***F21V 23/04*** | (2006.01) |
| ***F21Y 113/10*** | (2016.01) |
| ***F21Y 115/10*** | (2016.01) |
| ***F21Y 113/13*** | (2016.01) |

(52) U.S. Cl.
CPC ..... *F21V 19/04* (2013.01); *F21V 23/0414* (2013.01); *F21Y 2113/10* (2016.08); *F21Y 2113/13* (2016.08); *F21Y 2115/10* (2016.08)

(58) Field of Classification Search
CPC .. F21V 9/083; F21V 9/40; F21V 19/04; F21L 4/027; F21Y 2113/10; F21Y 2113/13
See application file for complete search history.

(56) References Cited

U.S. PATENT DOCUMENTS

| | | | | |
|---|---|---|---|---|
| 10,533,732 | B2 * | 1/2020 | Nakamura | A61B 90/30 |
| 2016/0366746 | A1 * | 12/2016 | van de Ven | F21K 9/235 |

* cited by examiner

HEAD-MOUNTABLE ILLUMINATORS WITH USER-SELECTABLE COLOR TEMPERATURE

REFERENCE TO RELATED APPLICATIONS

This application claims priority to, and the benefit of, U.S. Provisional Patent Application Ser. No. 62/904,316, filed Sep. 23, 2019, the entire content of which is incorporated herein by reference.

FIELD OF THE INVENTION

The present invention relates to headlights which can be mounted to eyeglasses, loupes, or headbands. In particular, the invention provides a plurality of LEDs having different color temperatures, or multi-color temperature conversions, to create an appropriate lighting environment.

BACKGROUND OF THE INVENTION

In dentistry, it is common to provide the practitioner with a lighting device for illuminating the oral cavity of the patient. Such lighting devices make it easier to care for and treat the patient.

It is important in dental lighting that shadows be minimized. To achieve this goal, existing lamps, which may be attached to the upper portion of a dental chair, include several bulbs. The light from the bulbs is irradiated in a pattern that prevents the occurrence of shadows by offsetting the light from one bulb with light in a different direction from another bulb.

However, with microvascular therapy, periodontal therapy, implant therapy, etc., a different lighting environment is required for treatment, and conventional dental lighting devices are insufficient. A different type of dental light would benefit these other procedures.

SUMMARY OF THE INVENTION

This invention overcomes deficiencies associated with the prior art by providing an illuminator with a user control enabling the selection of different color temperatures for different procedures. While ideally suited for dental applications, the illuminator may also be used for general medical, surgical and other applications unrelated to health care.

An illuminator constructed in accordance with the invention includes a housing having a forward and rear portions, including a light-transmission window disposed in the forward portion defining an optical axis. First and second circuit boards are disposed at least partially within the housing, including a first circuit board that is moveable with respect to the housing and a second circuit board that is fixed within the housing.

A plurality of light-emitting diodes (LEDs), mounted on the first circuit board, are configured to emit light toward the light-transmission window in the housing. A first set of electrical contacts on the first circuit board are in electrical communication with the plurality of light-emitting diodes, and a second set of electrical contacts on the second circuit board are in electrical communication with a source of electrical power. A user control, coupled to the first circuit board, enables a user to move the first circuit board between different positions, wherein, in each position, a different combination of the first and second sets of electrical contacts are in contact with one another, thereby causing different LEDs or combinations of the LEDs to emit light through the light-transmission window in the housing.

In the preferred embodiments, the plurality of LEDs have different color temperatures. For example, for dental applications, the plurality of LEDs may include one or more of the following color temperatures: i.e., "warm" at about 3700K; "neutral" at 4000-4700K; and "cool" at 5700-6500K. Movement of the user control may cause the first circuit board to rotate relative the second circuit board within the housing. Alternatively, movement of the user control may cause the first circuit board to translate back and forth relative the second circuit board within the housing. Regardless, in each position, different modes of operation are possible. For example, only one of the LEDs may be illuminated, and the illuminated LED may be on-axis with the light-transmission window. Alternatively, a plurality of the LEDs may be illuminated, such that the different color temperatures are combined in the output beam.

The source of electrical power may be remote from the illuminator, including a cable for bringing power from the remote source into the housing from a battery back, for example. Alternatively, the source of electrical power may be a battery disposed within the housing without the need for a cable.

The rear portion of the housing may include a mount for attaching the illuminator to eyeglass frames, a headband, or other head-mounting apparatus. The mount may facilitate multi-directional positions, including up-down and side-side movements. One or more optical elements may be disposed within the housing to shape the light emitted through the light-transmission window in the housing. For example, a lens may be supported in the light-transmission window to focus the light emitted by the illuminator.

DETAILED DESCRIPTION OF THE INVENTION

Figure 1:
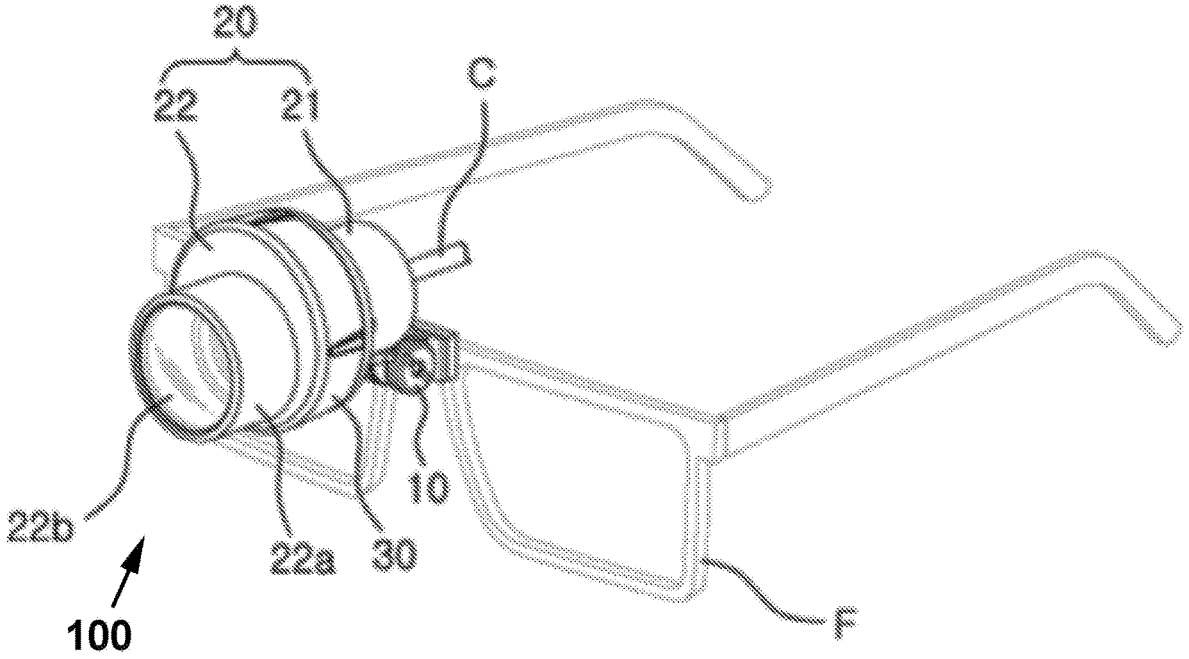
FIG. 1 is an oblique view of an embodiment of the invention mounted on a pair of eyeglass frames including a rotational user control.
Figure 2:
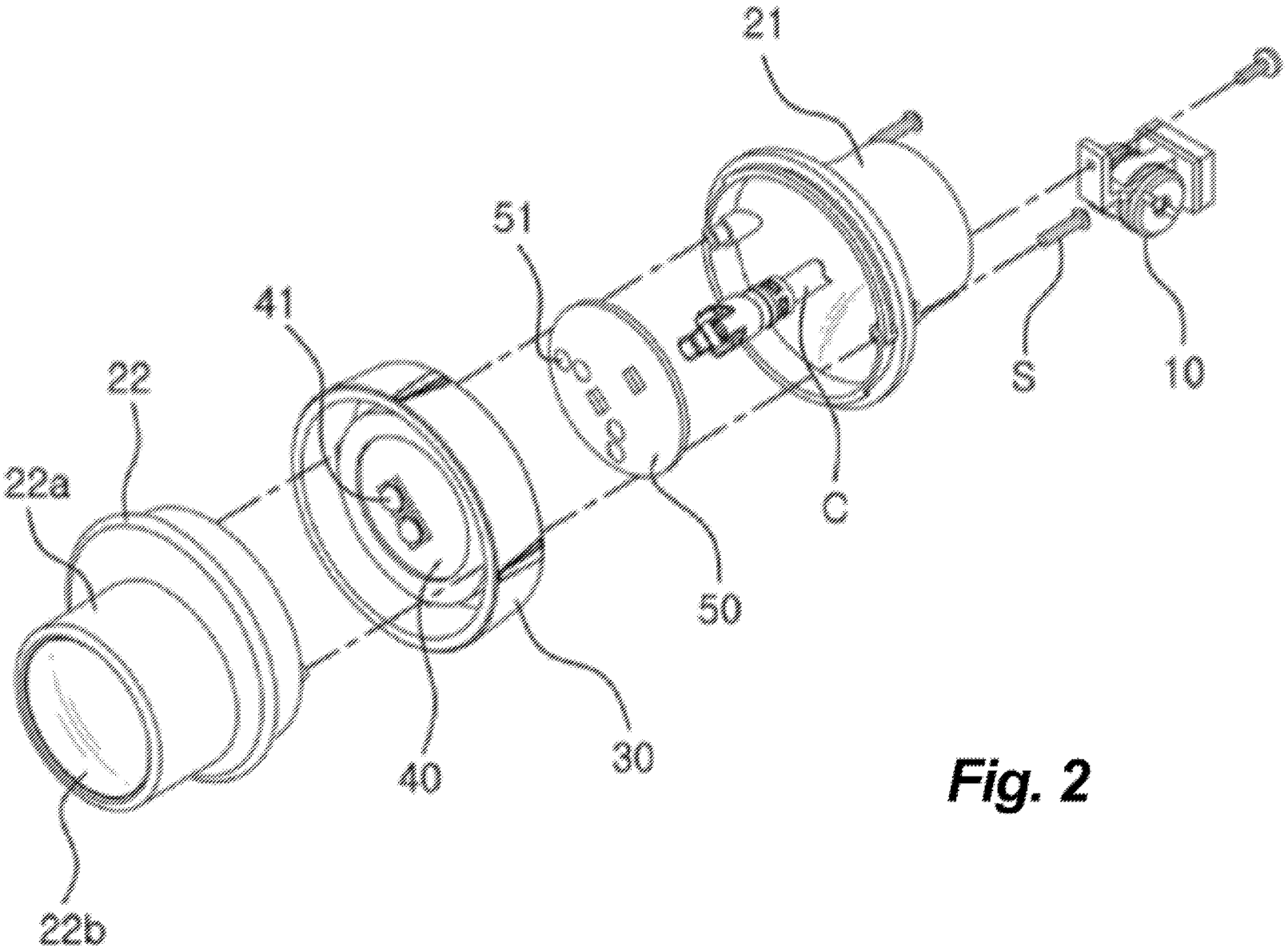
FIG. 2 is an exploded view of the embodiment of FIG. 1 seen from a first perspective.
Figure 3:
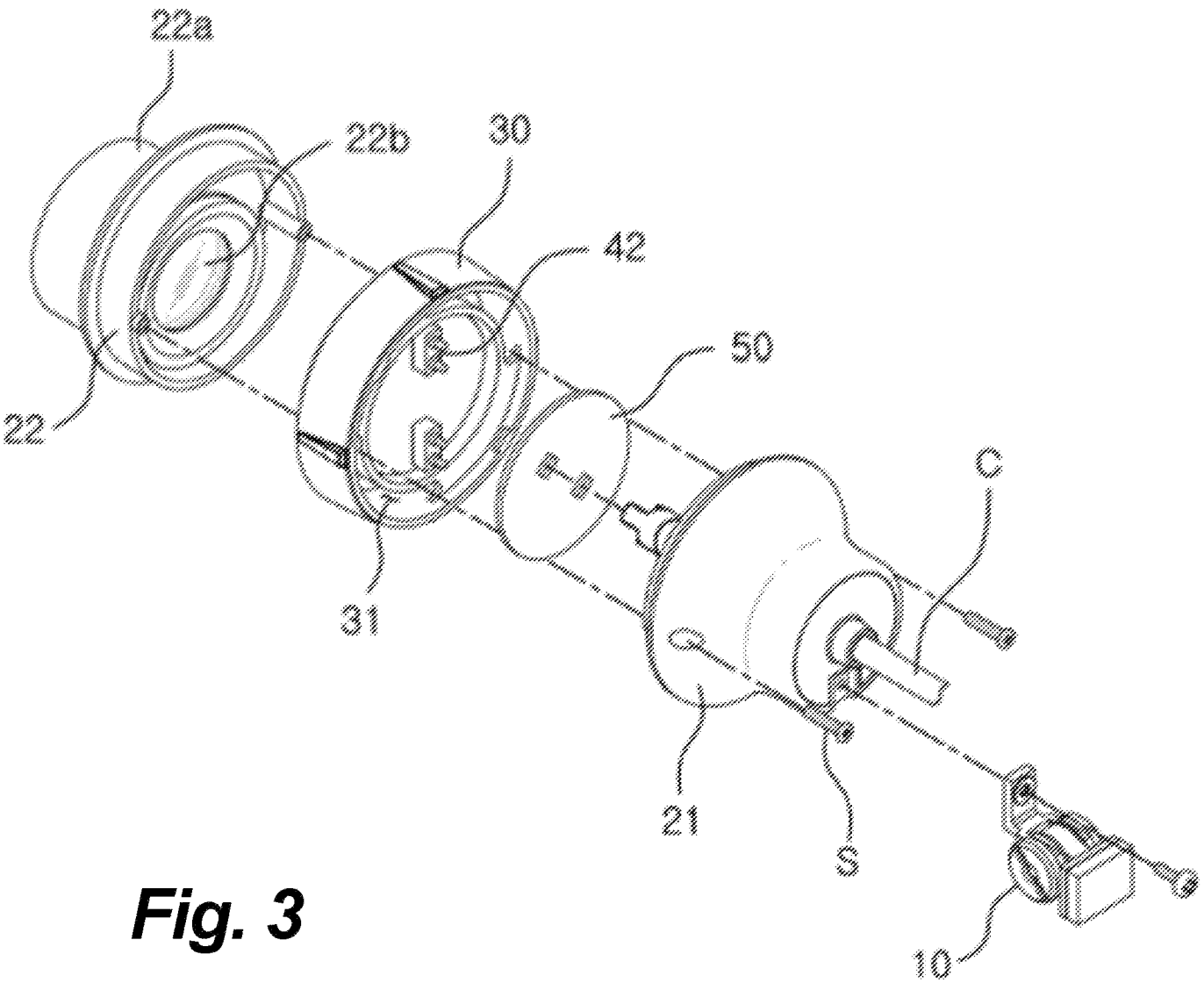
FIG. 3 is an exploded view of the embodiment of FIG. 1 seen from a different perspective.
Figure 4A:
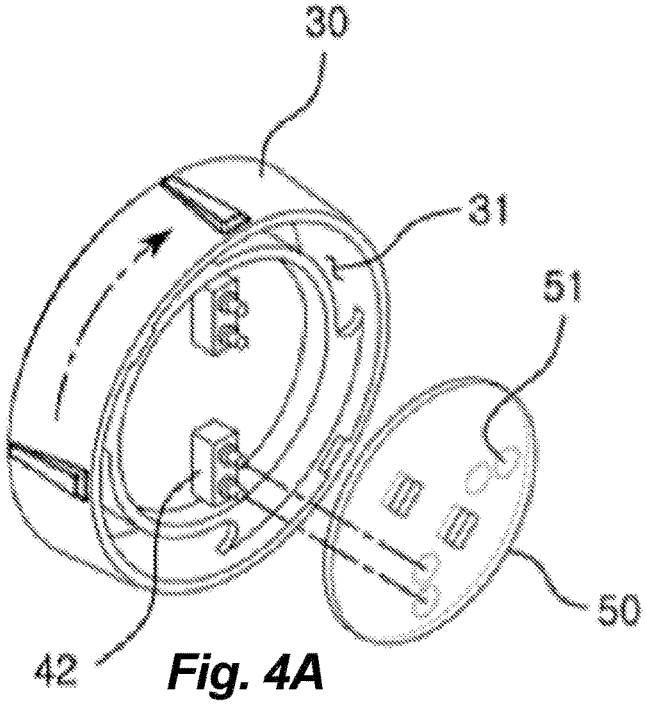
FIG. 4A is a perspective view illustrating board-to-board electrical communication at one position of the rotational user control.
Figure 4C:
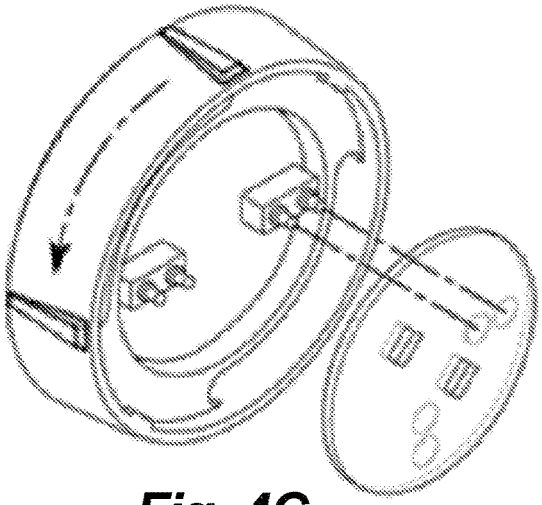
FIG. 4C is a front view through the light-transmission window illustrating on-axis light emission from a first LED at one position of the rotational user control.
Figure 4B:
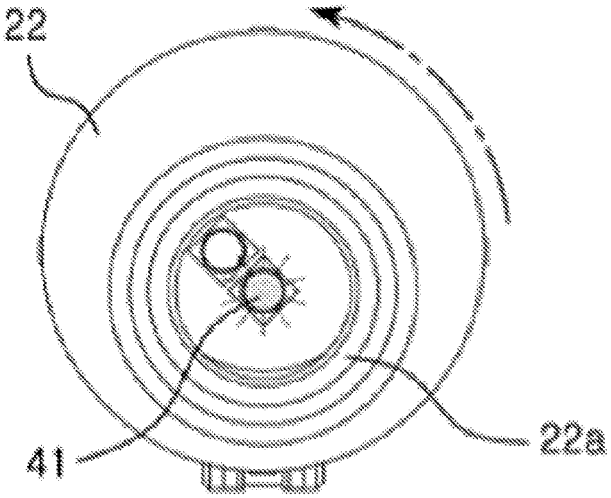
FIG. 4B is a perspective view illustrating board-to-board electrical communication at a different position of the rotational user control.
Figure 4D:
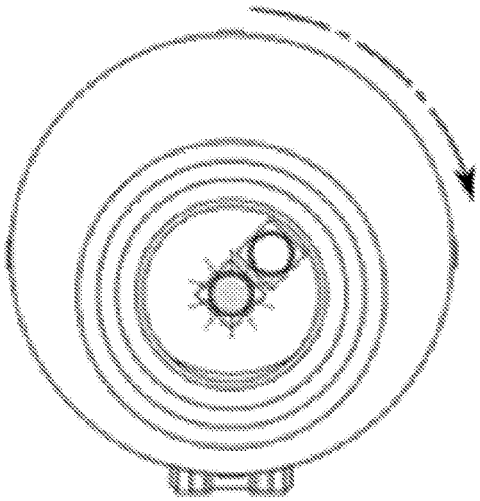
FIG. 4D is a front view through the light-transmission window illustrating on-axis light emission from a different LED at a different position of the rotational user control.
Figure 5A:
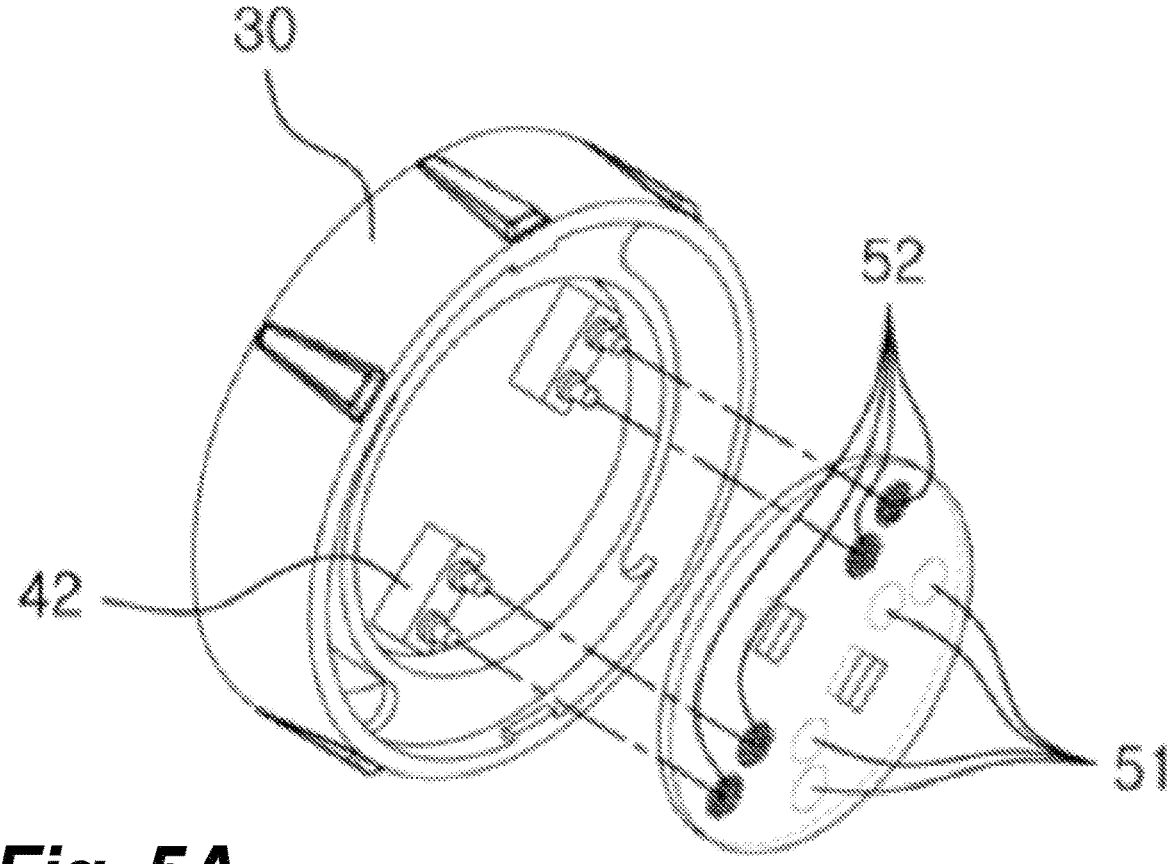
FIG. 5A is a perspective view illustrating board-to-board electrical communication facilitating multi-LED activation.
Figure 5B:
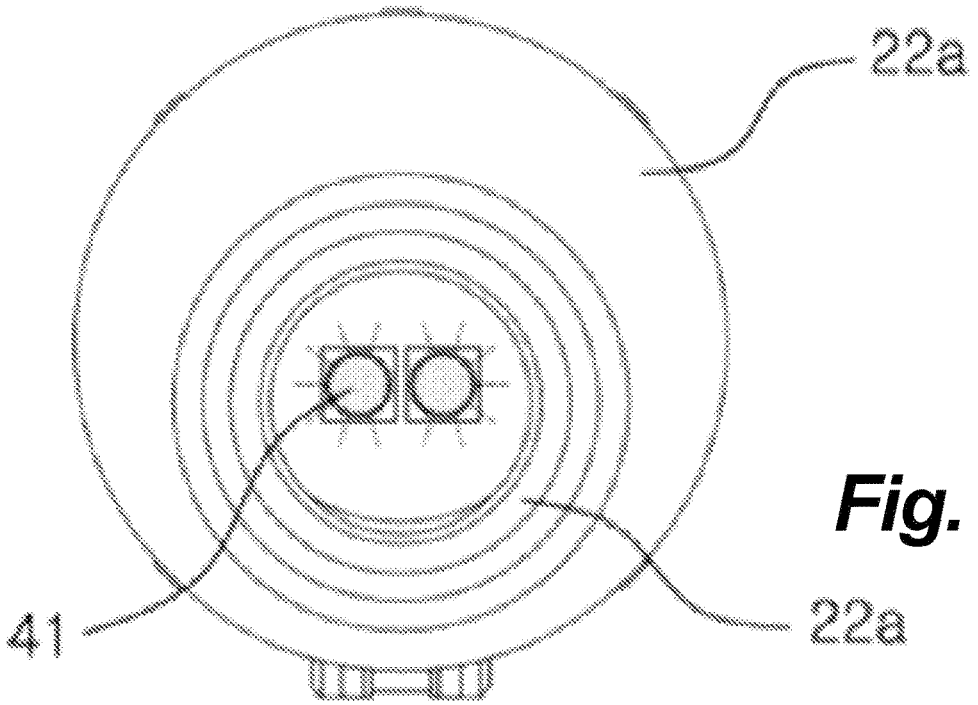
FIG. 5B is a front view through the light-transmission window illustrating multi-LED activation with two LEDs, neither of which is precisely on-axis.

Hereinafter, the present invention is described in detail by referring to the attached drawings. FIG. 1 shows one embodiment of a multi-color temperature conversion dental lighting fixture 100 installed on glasses according to the present invention, in particular the bridge portion of the frames F. FIGS. 2, 3 are exploded views seen from different perspectives, and FIGS. 4, 5 illustrate activation of LED light sources.

The fixture 100 comprises a control knob 30 coupled to a casing 20 which houses first and second circuit boards 40, 50. A mechanism 10 allows the fixture to be oriented in multiple dimensions, including pivoting up and down; and up-down and side-to-side movements. The casing 20 includes a rear body portion 21 and a front cover 22 with a light transmission portion 22*a* including light transmission window 22*b*. A cable C protrudes through the rear body portion 21.

The cover 22 is installed and secured on the open front of the body 21 to form a sealed casing 20, and the light transmission portion 22*a* is arranged in a eccentric way downwards. A number of lenses may installed in the light transmission window 22*b*. Light emitted from LED 41 in FIG. 2 is emitted externally through the lens 22*b* of the light transmission window 22*a*.

Control knob 30 is installed so that it can be rotated from the outside side of the casing 20. In addition, the control knob 30 is rotatable on the outer side of the connecting part of the body 21 and the cover 22. When control knob 30 is rotated, the first board 40 rotates along with it. The knob 30 is preferably formed with a curved groove 31. A number of screws S are installed at the edges of the body 21 and cover 22 to hold each other. The screws S penetrate the curved groove 31 formed in the control knob 30. As such, turning the control knob 30 will leave the screws S installed in the casing 20 in place without moving. That is, the control knob 30 is capable of rotating without being obstructed by the screws S.

As mentioned, the first board 40 is installed inside the casing 20 such that the board 40 rotates when the control knob rotates. A plurality of LEDs 41 having a different color temperatures are disposed on the front of the first board 40 as seen in FIG. 2. The rear portion of board 40 is provided with a plurality of terminal pins 42 connected to each of the LEDs 41.

In the case of dental treatment, it is important to establish an appropriate lighting environment depending on the treatment. For example, when light-sensitive composite materials, a warm color temperature may be optimal, whereas periodontal treatment should use light with a neutral color temperature. A cooler color temperature is advantageous for certain surgical procedures involving veins or nerves. In order to address these different treatment characteristics, in accordance with the present invention a plurality of LEDs are used to provide these (or other) different color temperatures to establish the most suitable lighting environment for the treatment. Note that while specific color temperatures are listed above for particular dental applications, the invention is not limited in this regard, and may also be used for other medical, surgical or other applications benefitting from different color temperatures or combinations thereof.

Note that LEDs are not installed in the center of the first board 40, but are instead installed eccentrically on the front of the first board 40. Light transmission portion 22*a*, as described earlier, is also located eccentrically in the cover 22, and not in the center of the cover 22. Using this arrangement, as control knob 30 and board 40 are rotated, only one of the LEDs 41 is in optical alignment with the light transmission portion 22*a* and window 22*b*.

Second board 50 is placed on the rear side of the first board 50 and connected to the cable C through the rear of the body 21 to receive electrical current and control signals through cable C. The second board 50 includes contact terminals 51 that engage electrical communication with a plurality of terminal pins 42 provided in the first board 40. Thus, when the first board 40 is rotated with control knob 30, only one set of the terminal pins 42 makes contact with the individual contact terminals 51 such that only the LED in optical alignment with the light transmission portion is activated. The other LED is not illuminated.

FIG. 4 illustrates operation as the control knob is turned. In FIG. 4A, the LED associated with contacts 42 is illuminated, causing that LED 41 to shine through len(s) installed in light-transmission portion 22*a*, as seen in FIG. 4B. When the control knob 30 is rotated as shown in FIG. 4C, the other LED makes contacts with contacts 51, and is instead illuminated through the transmission portion 22*a*, as seen in FIG. 4D. Assuming the two LEDs have different color temperatures, this enables a user to quickly and easily switch between the two color temperatures through a partial rotation of control knob 30.

FIG. 5 illustrates an alternative embodiment wherein one or more LEDs may be illuminated simultaneously. In this case, control know 30 has three positions, including a first position to light one of the LEDs, a second position to activate the other of the LEDs, and a third position all LEDs (41) are lit at the same time. This capability may be used to provide a combination of lighting from a number of LEDs that have different color temperatures.

Whereas, in the embodiments so far described with reference to FIG. 1 through 5, two or more LEDs are used to emit different color temperatures. However, it is also possible according to the invention to adjust the driving current values provided for each LED to indicate a greater variety of color temperatures.

Figure 6:
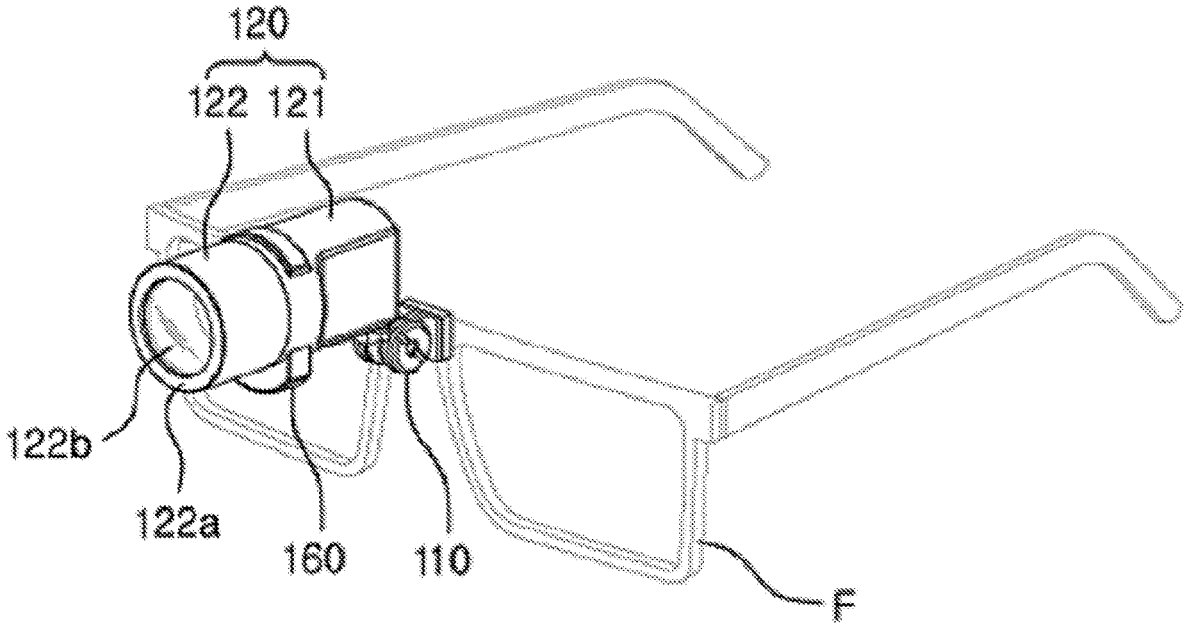
FIG. 6 is an oblique view of an alternative embodiment of the invention mounted on a pair of eyeglass frames including a translational user control.
Figure 7:
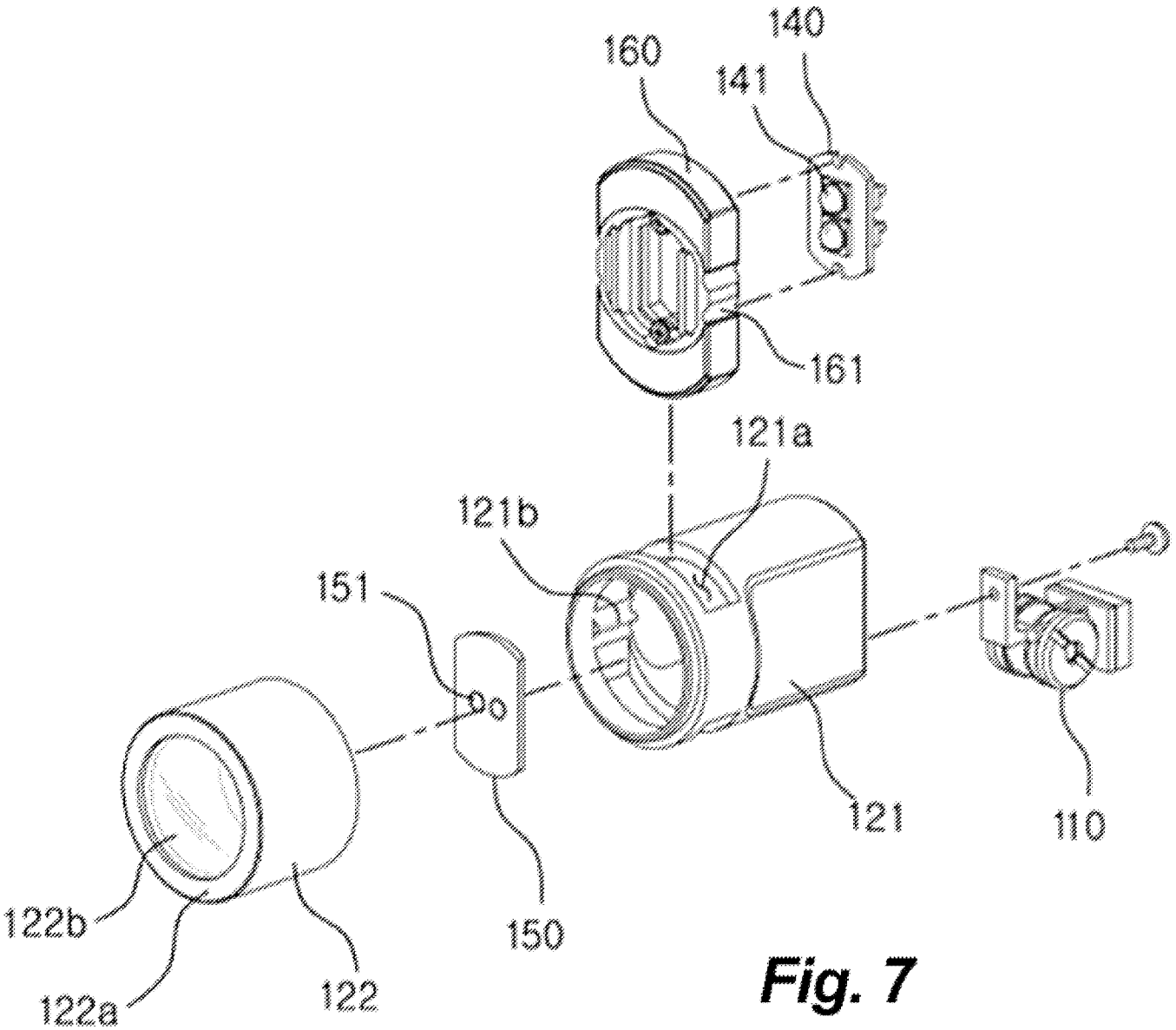
FIG. 7 is an exploded view of the embodiment of FIG. 6.
Figure 8A:
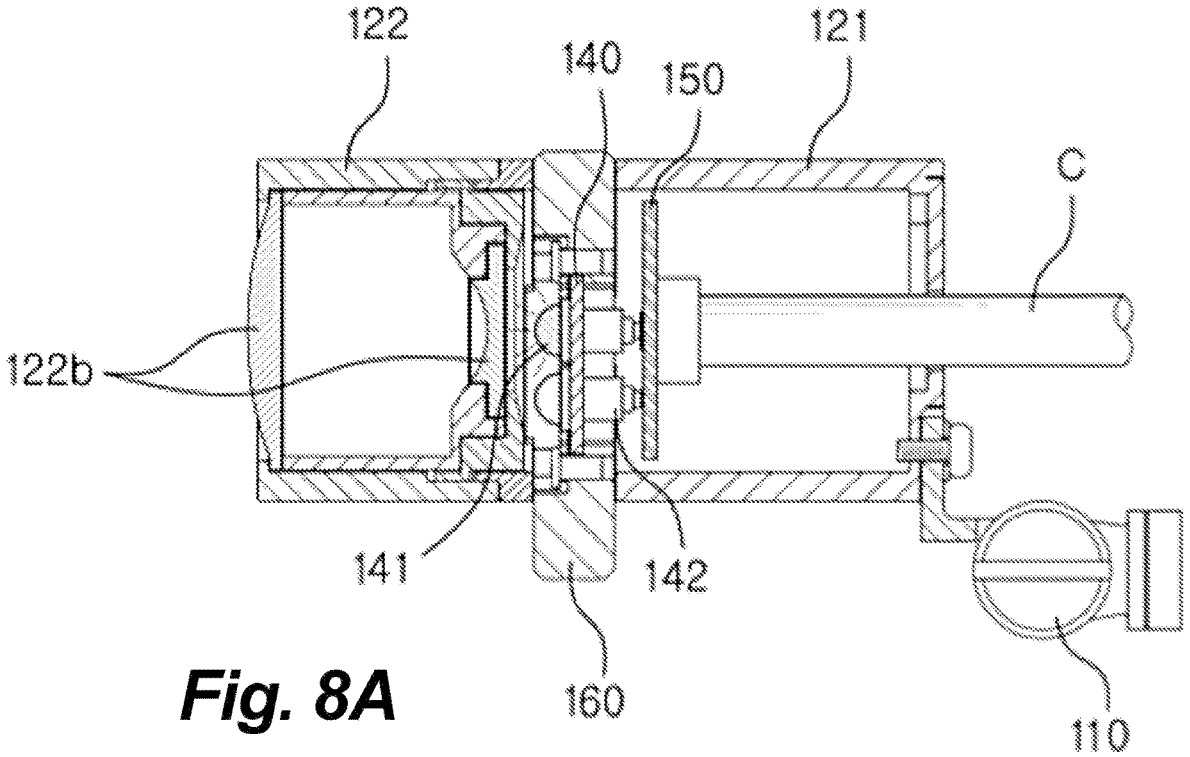
FIG. 8A is a side-view cross section of the embodiment of FIG. 6.
Figure 8B:
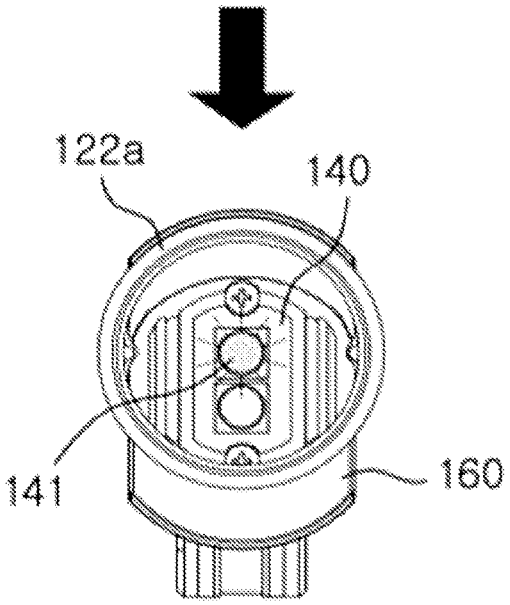
FIG. 8B is a front view through the light-transmission window illustrating on-axis light emission from a first LED at one position of the translational user control.
Figure 8C:
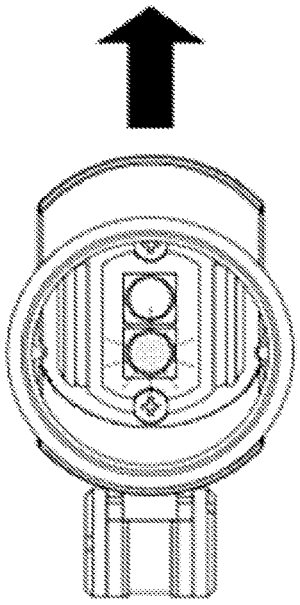
FIG. 8C is a front view through the light-transmission window illustrating on-axis light emission from a different LED at a different position of the translational user control.
Figure 9A:
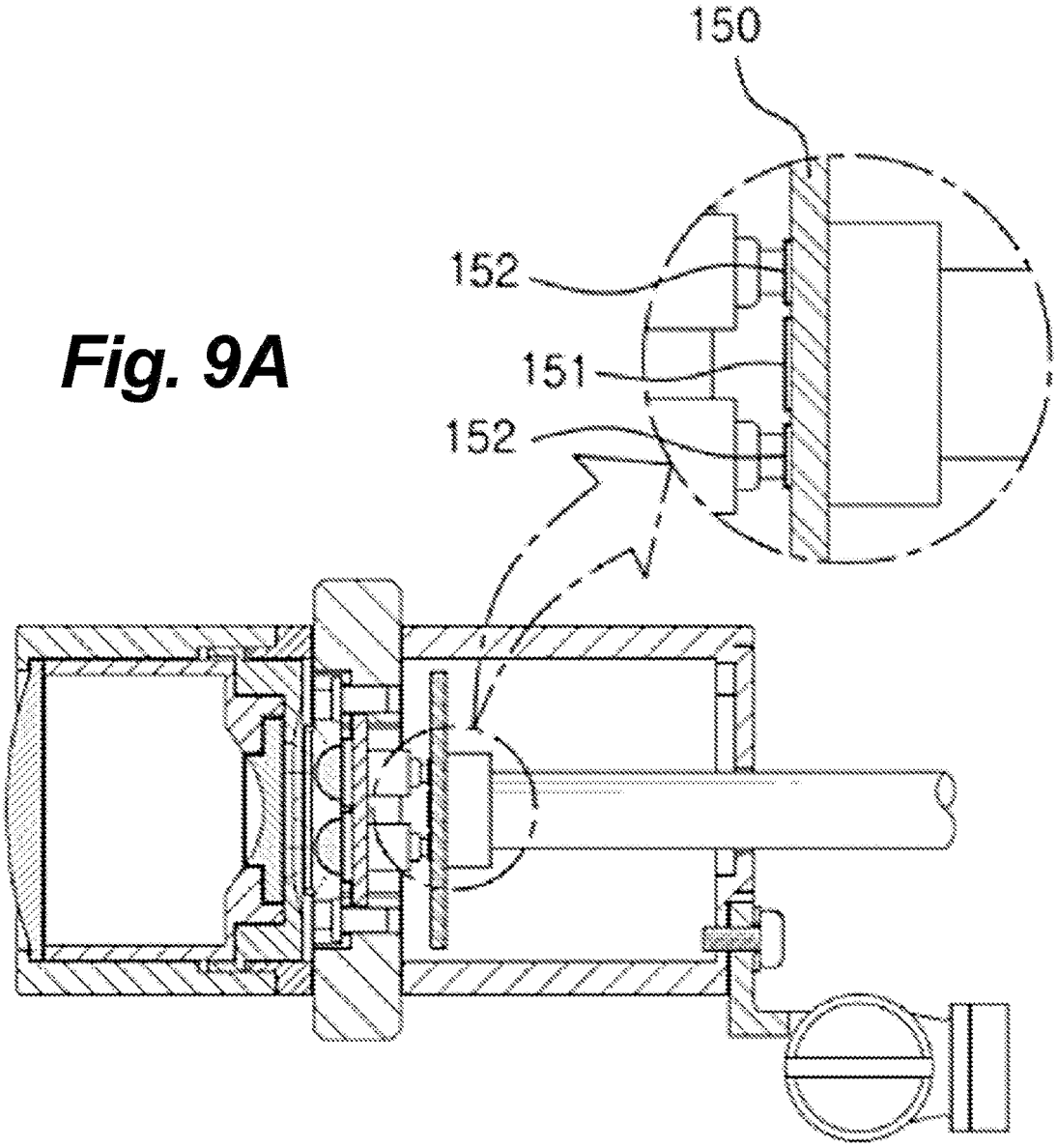
FIG. 9A is a side view cross section illustrating board-to-board electrical communication facilitating multi-LED activation.
Figure 9B:
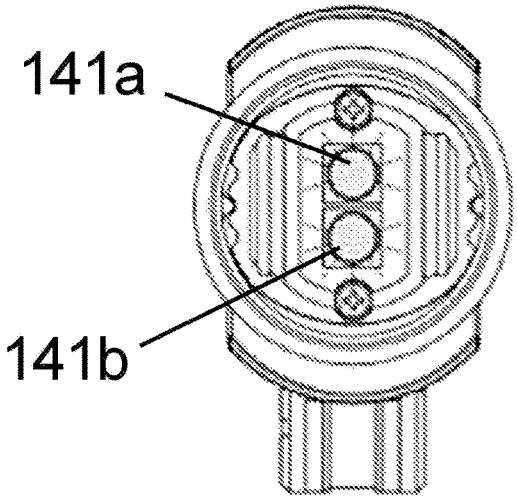
FIG. 9B is a front view through the light-transmission window illustrating multi-LED activation with two LEDs, neither of which is precisely on-axis.

FIGS. 6 through 9 illustrate another example of a multi-color temperature-conversion dental lighting fixture that uses a translation control as opposed to a rotation control. FIG. 6 shows the fixture installed on eyeglass frames according to the invention; FIG. 7 is an exploded oblique view; FIG. 8 depicts the fixture when the LED is lit; and FIG. 9 illustrates contact terminal configurations.

The translation control embodiment features a casing 120 coupled to frame mount 110 and a slider 160 that moves up and down relative to casing 120. As with the rotation control embodiment, mount 110 may be coupled to the bridge part of the glasses frame (F) facilitating up, down, right, left and angular directionality, including angular adjustment about the optical the axis of output light.

FIG. 7 shows a first board 140 installed on slider 160 and second board 150 installed inside the casing 120. Casing 120 is mounted on the glasses frame (F) by being installed at the end of the mount 110. Light transmission window 122*a* is provided in the front, and a slider slot 121*a* is formed on both sides of body 121.

In more detail, casing 120 comprises a body 121 and a cover 122 installed on the body 121. Body 121 is installed at the front end of the mount 110. As shown in FIG. 8A, cable C penetrates through the enclosed rear of body 121. In addition, a stopping projection 121*b* is formed on both sides of the inner surface of the body 121. The cover 122 is installed and secured on the open front of the body 121 to form a sealed casing 120, and is equipped with a light transmission window 122*a*. One or more lenses 122*b* are installed in the light transmission window 122*a*. The light emitted from LEDs 141 is emitted externally through the lens 122*b* of light transmission window 122*a*.

As discussed, slider 160 extends through the middle of the fixture, and is moveable up and down through the sliding hole 121*a* of the casing 120. Note that when the slider 160 moves, the first board 140 moves along with it. As presented in FIG. 7, on both sides of the slider 160, a number of detents 161 are formed for interaction with the stopping projection 121*b* formed in the body 121. Thus, when the slider 160 is sliding up and down, the stopping protrusion 121*b* engages with one or the other of the detents to maintain the slider in the up or down position.

As mentioned, the first board 140 moves together when the slider 160. The first board 140 is equipped with a number of LEDs 141, each with a different color temperature. Terminal pins associated with the LEDs 141 are exposed on the rear of first board 140. The second board 150 is located behind the rear surface of the first board 140. Current and control signals are provided from the cable through the rear of the body 121. The second board 150 provides individual contact terminals 150. Therefore, when the first board 140 moves up and down, only the LED 141 that is in optical alignment with the lens(es) in the light-transmission window lights up.

Operation is best seen in FIGS. 8B and 8C. In FIG. 8B, slider 160 is down, and only LED 141*a* on center in the window is activated. In FIG. 8C, slider 160 is up, and only LED 141*b*, on center in the window, is activated. As shown in FIG. 9A, the individual contact terminals 151 formed on the second board 150 are selectively in contact with the terminal pins 142 formed on the first board 140 when the first board 140 is moved a predetermined distance. In particular, when moving the first board 140, only the terminal pin(s) connected to the LED located in the center of the light transmission window 122*a* is in contact with the individual contact terminals 151. In other words, when the first board 140 is moved, only the LED in the center of the light transmission window 122*a* is lit, the remaining LED is not lit.

However, as with the rotation control embodiment, it is also possible to ensure that all LEDs 141 are lit at the same time, as shown in drawing 9B. In this case, the terminals and detents are arranged to provide a "middle position" wherein both LEDs 141*a* and 141*b* are illuminated. This can add to the versatility of the lighting arrangement, with different combinations of LEDs with different color temperatures being used selectively for different treatment situations. It is also possible to adjust the driving current values provided for each LED 141 to indicate a greater variety of color temperatures. Further, note that while the slider is moved upon and down in the preferred embodiment, the slider may alternatively move from side-to-side.

The invention claimed is:

1. An illuminator, comprising:

a housing having a forward portion and a rear portion;

a light transmission window disposed in the forward portion of the housing, the light-transmission window defining an optical axis;

first and second circuit boards disposed at least partially within the housing, including a first circuit board that is moveable with respect to the housing and a second circuit board that is fixed within the housing;

a plurality of light-emitting diodes (LEDs) mounted on the first circuit board, the LEDs being configured to emit light toward the light-transmission window in the housing;

a first set of electrical contacts on the first circuit board, the first set of electrical contacts being in electrical communication with the plurality of light-emitting diodes;

a second set of electrical contacts on the second circuit board, the second set of electrical contacts being in electrical communication with a source of electrical power; and a user control coupled to the first circuit board enabling a user to move the first circuit board between different positions, and wherein, in each position, a different combination of the first and second sets of electrical contacts are in electrical communication with one another, thereby causing different LEDs or combinations of the LEDs to emit light through the light-transmission window in the housing.

2. The illuminator of claim 1, wherein the plurality of LEDs have different color temperatures.

3. The illuminator of claim 1, wherein the plurality of LEDs have different color temperatures, including one or more of the following color temperatures:

warm at 3700K;

neutral at 4000-4700K; and cool at 5700-6500K.

4. The illuminator of claim 1, wherein the rear portion of the housing includes a mount for attaching the illuminator to eyeglass frames, a headband, or other head-mounting apparatus.

5. The illuminator of claim 4, wherein the mount facilitates up-down and side-side movements.

6. The illuminator of claim 1, wherein movement of the user control causes the first circuit board to rotate relative the second circuit board within the housing.

7. The illuminator of claim 1, wherein movement of the user control causes the first circuit board to translate or slide back and forth relative the second circuit board within the housing.

8. The illuminator of claim 1, wherein, in each position:

only one of the LEDs is illuminated; and the illuminated LED is on-axis with the light-transmission window.

9. The illuminator of claim 1, wherein, in one position, a plurality of the LEDs are illuminated.

10. The illuminator of claim 1, wherein the source of electrical power is remote from the illuminator, including a cable for bringing power from the remote source into the housing.

11. The illuminator of claim 1, wherein the source of electrical power is a battery disposed within the housing.

12. The illuminator of claim 1, further including one or more optical elements disposed within the housing to shape the light emitted through the light-transmission window in the housing.

13. The illuminator of claim 1, further including a lens supported in the light-transmission window to focus the light emitted by the illuminator.

14. The illuminator of claim 1, wherein there are two LEDs mounted on the first circuit board, each LED exhibiting a different color temperature.

* * * * *